US008193940B2

(12) United States Patent
Cummings et al.

(10) Patent No.: US 8,193,940 B2
(45) Date of Patent: Jun. 5, 2012

(54) RECOGNITION AWARD, PERSONNEL IDENTIFICATION HOLDER AND/OR PERSONNEL UNIT FOR ATTACHMENT TO HARDHATS, PROTECTIVE HELMETS OR THE LIKE

(76) Inventors: Timothy Alan Cummings, Hurst, TX (US); Joseph Nick Filadelfia, Jr., Fort Worth, TX (US)

( * ) Notice: Subject to any disclaimer, the term of this patent is extended or adjusted under 35 U.S.C. 154(b) by 341 days.

(21) Appl. No.: 12/586,564

(22) Filed: Sep. 24, 2009

(65) Prior Publication Data

US 2011/0068918 A1 Mar. 24, 2011

(51) Int. Cl.
*G08B 13/14* (2006.01)
*A42B 1/24* (2006.01)
*F21L 15/14* (2006.01)

(52) U.S. Cl. ..... 340/572.8; 340/572.1; 2/422; 362/106

(58) Field of Classification Search ..... 340/572.1, 340/572.7, 572.8, 572.9, 539.11, 539.13, 340/479, 540, 10.1, 10.51; 2/94, 410, 413, 2/422; 250/336.1, 374, 484.3, 484.5; 362/106
See application file for complete search history.

(56) References Cited

U.S. PATENT DOCUMENTS

| | | | | |
|---|---|---|---|---|
| 2,803,829 | A | 8/1957 | Tscharner | 40/329 |
| 4,764,989 | A | 8/1988 | Bourgeois | |
| 5,045,700 | A * | 9/1991 | Crowson et al. | 250/336.1 |
| 5,083,031 | A * | 1/1992 | Hoelsher et al. | 250/484.3 |
| 5,548,847 | A | 8/1996 | Spicijaric | 2/209.13 |
| 5,658,065 | A * | 8/1997 | Jamieson | 362/106 |
| 5,915,539 | A | 6/1999 | Lack | 2/422 |
| 6,032,394 | A | 3/2000 | Hand et al. | 40/651 |
| 6,157,298 | A * | 12/2000 | Garfinkel et al. | 340/479 |
| 6,616,294 | B1 | 9/2003 | Henry | |
| 6,751,805 | B1 * | 6/2004 | Austion | 2/94 |
| 6,904,147 | B2 | 6/2005 | Lenz et al. | |
| 7,093,305 | B2 | 8/2006 | Reilly et al. | 2/209.13 |
| 7,598,869 | B2 * | 10/2009 | Kumagai et al. | 340/572.1 |
| 8,001,623 | B2 * | 8/2011 | Gertsch et al. | 2/422 |

OTHER PUBLICATIONS

New ANSI Standard Head Protection Technical Bulletin, 2003.

* cited by examiner

*Primary Examiner* — Van T. Trieu
(74) *Attorney, Agent, or Firm* — Schulta & Associates, P.C.

(57) ABSTRACT

A signal device is provided for identifying and communicating a location or hazard, concealed within a housing on a hard hat having a pocket. Further provided is a detachable housing to be placed in the pocket. Embodiments incorporate a speaker for audible identification, a light emitting diode (LED) for visual identification and a global positioning sensor (GPS) for identifying the wearer's location and various circuits and systems that utilize the invention.

15 Claims, 10 Drawing Sheets

RECOGNITION AWARD, PERSONNEL IDENTIFICATION HOLDER AND/OR PERSONNEL UNIT FOR ATTACHMENT TO HARDHATS, PROTECTIVE HELMETS OR THE LIKE

CROSS-REFERENCE TO RELATED APPLICATIONS

This application claims priority to U.S. application Ser. No. 11/448,209 filed Jun. 7, 2006, entitled "Recognition Award, Personnel Identification Holder and/or Personnel Unit for Attachment to Hardhats, Protective Helmets or the Like" and thereby to U.S. Provisional Application No. 60/688,157 filed on Jun. 7, 2005.

FIELD OF INVENTION

The present invention relates to protective helmets and more particularly to a recognition award and/or personnel identification holder and recognition award and/or personnel identification unit for attachment to hardhats, protective helmets or the like.

BACKGROUND OF INVENTION

Hardhats, safety helmets and protective helmets are common articles that are worn at construction sites. Furthermore, hardhats and protective helmets have a pocket slot so that accessories can be attached to the hardhats easily.

U.S. Pat. No. 6,616,294 to Henry discloses a hard hat mounted flashlight holder for use with the conventional hardhat to releasably receive a flashlight.

U.S. Pat. No. 4,764,989 to Bourgeois discloses a pair of strap retainers being mounted on opposite sides of a safety helmet for securing safety goggles in a storage position.

U.S. Pat. No. 6,904,147 to Lenz discloses a hard hat mount assembly for mounting a speaker device on the hardhat.

In the prior art, recognition for individuals was usually accomplished by placing paper or plastic stickers with a backing of adhesive on the hard hat or protective helmet. The stickers are very inexpensive and do not necessarily show the appreciation or recognition for the user of the hard hat or protective helmet. Additionally, the stickers can be easily damaged and do not provide a lasting and a professional appearance to recognize the performance of the user. Furthermore, the stickers cannot be removed or updated without replacing the hard hat or protective helmet.

Alternatively, many companies use high quality awards such as label pins to recognize employees for superior performance, milestone time periods of service, milestone time periods of safe work etc. Particularly in industrial and construction applications, it is difficult to provide employees with recognition awards that they can wear daily. Metal awards can be unsafe if worn in the workplace and easily damaged or destroyed by conditions in the workplace. ANSI standards to not allow attachment pins or other metal items to be placed on hard hats and protective helmets. Metal items worn on the head invite electrical shock hazards. Furthermore, the prior art does not provide for easily removable or replaceable modular safety or warning devices for protective helmets.

SUMMARY OF THE INVENTION

The present invention provides a method and detachability connected holder for attaching recognition awards and or personnel identifiers such as a RFID chip or the like to hard hats and protective elements utilizing an accessory slot or pocket on the hard hats and helmets and for removing the holder, and for the recognition award/personnel identification unit that is retained within the holder. Additional embodiments of the device incorporate a speaker for audible identification, a light emitting diode (LED) for visual identification, a global positioning sensor (GPS) for identifying the wearer's location, and a personal dosimeter for timely detection of harmful radiation.

The recognition award/personnel ID holder is nonconductive and allows the user to attach a variety of awards so that the user of the hardhat would be recognized for years of service, time work safely and other matters of performance.

The recognition award/personal identification unit can be made from plastic, metal, or other materials and can be stamped, engraved, painted or have other similar surfaces for customization. The unit can be installed with or without a clear plastic lens.

Another use for the user of the hardhat would be a detachable connected holder for identification, locating, tracking or finding the user utilizing a chip including a transmitter, microprocessor or other device which allows other individuals to track the user of the hardhat or protective helmet.

The present invention can be used with differing shapes, sizes and coloration in order to customize it for different company and industry needs.

The LED may function as a visual aid to the wearer or as a means of locating the wearer from a distance. Further, the LED may serve as a forward looking light to aid visual perception of the wearer's surroundings in dark situations.

The speaker provides a warning or identification capability by emitting a predetermined sound when activated.

The GPS allows tracking the location of the wearer presently or the path travelled by the wearer throughout the day.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

Figure 15:
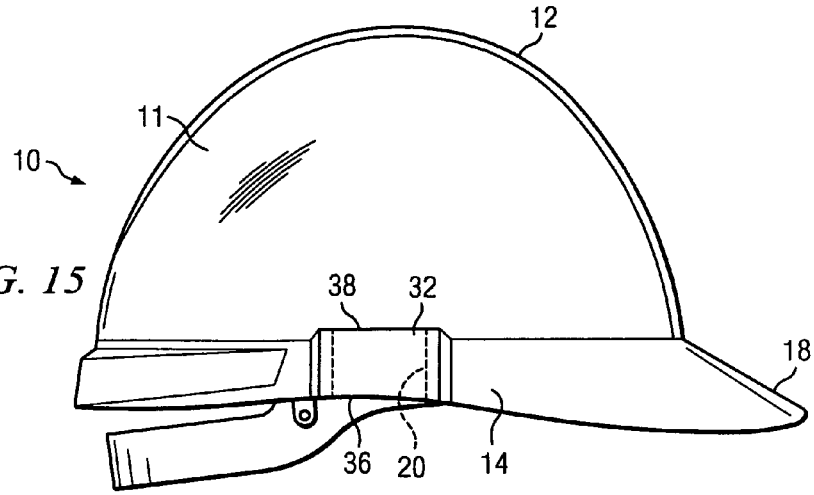
FIG. 15 illustrates a cross-sectional view of a hardhat with a pocket.

As shown in FIG. 15, safety helmets, protective hats or hardhats 10 are usually formed as a one-piece molded shell 11 of durable, high-impact material having a dome-shaped crown 12 which transitions into a radially-flared rim 14. A portion of the rim 14 is extended forwardly to define a protective visor 18. The visor 18 projects outwardly from the crown 12 for a substantially greater distance than from the side and back portions of the rim 14.

The pocket 20 or accessory slot is formed in the shell 11 on opposite sides of the helmet for receiving a detachedly connected holder 30. The pocket 20 may be bounded on one side by the shell 11 and on the other side by bracket panel 32. The bracket panel 32 is provided with a lower edge 36 and an upper edge 38 which define latching surfaces for interlocking engagement with the detachedly connected holder 30.

Figure 1:
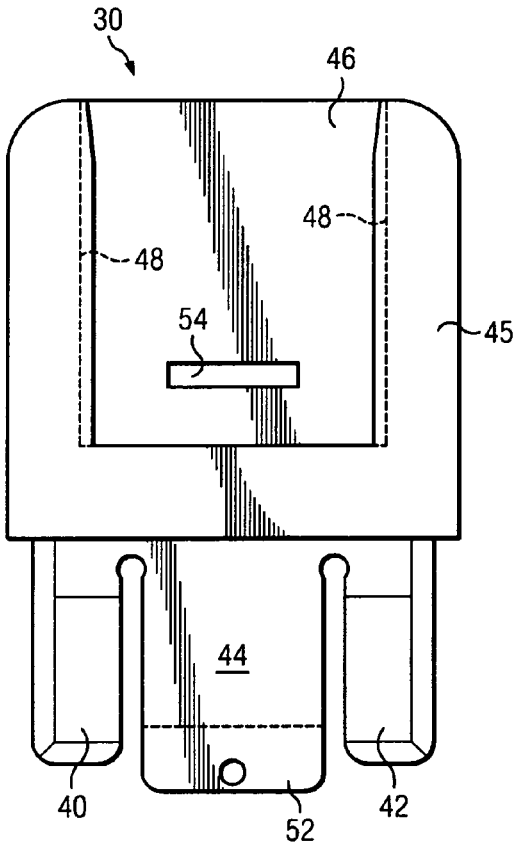
FIG. 1 illustrates a cross-sectional view of the detachedly connected holder of the present invention.

Referring now to FIG. 1, the detachedly connected holder 30 is provided with resilient guiding arms 40, 42 which project in a spaced relation from an elongated body member 45 to guide the guiding arms 40, 42 into the pocket 20 and is provided with an engaging arm 44 to engage and hold the detachedly connected holder 30 into the helmet. A depression 46 is formed in the elongated body member 45 and extends through the end of the elongated body member 45 which opposes the guiding arms 40, 42 and the engaging arm 44. A pair of open slots 48 is formed along the depression 46 of the body member 45. The engaging arm 44 includes an outwardly projecting retention catch 52 to engage the lower edge 36 of the pocket 20. The open slots 48 extend the length of the depression 46 in the longitudinal direction. The open slots 48 and the depression 46 accept an award or personnel unit 78 which may include indicia 74 for an award or personnel identification. The elongated body member 45 includes a centrally located detention slot 54 for accepting an outwardly projecting tab 76 positioned on the personnel unit 78 in order to retain the personnel unit 78 in the depression 46. Subsequently, the personnel unit 78 can be released from the detention slot 54 so that the personnel unit 78 can be replaced by a new personnel unit 78. Consequently, the personal unit 78 is detachedly connected to the detachedly connected holder 30. The engaging arm 44 deflects inwardly towards the hard hat 10 to provide spring pressure so that the detachedly connected holder 30 is retained within the pocket 20. The engaging arm 44 additionally includes an outwardly extending retention catch 52 to engage the lower edge 36 of the hard hat 10.

Figure 2:
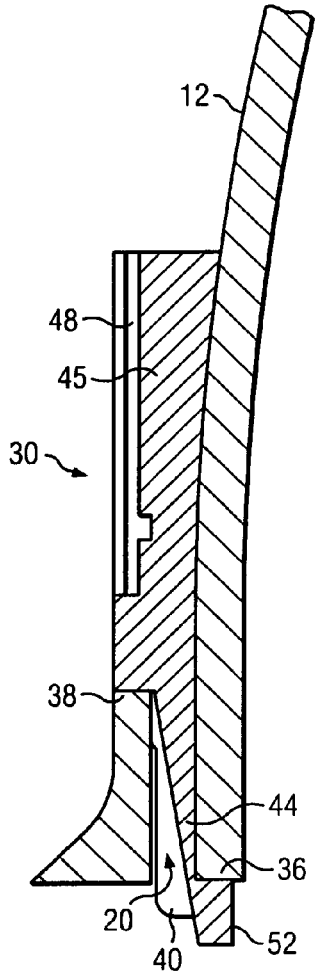
FIG. 2 illustrates a cross-sectional view of the side of the dome shape crown and detachedly connected holder.

FIG. 2 illustrates a side view of the dome shape crown 12, the pocket 20, the guiding arms 40, 42, the retention 52 and the engaging arm 44. The engaging arm of 44 is shown angled towards the dome shape crown 12 and the retention catch 52 positioned under the lower edge 36 of the pocket 20. FIG. 2 additionally shows that the front side of the detachable connected holder 30 is substantially flat, but the back side of the detachedly connected holder 30 is concavely curved to approximately correspond to the convexly curved surface of the dome shape crown 12.

Figure 3:
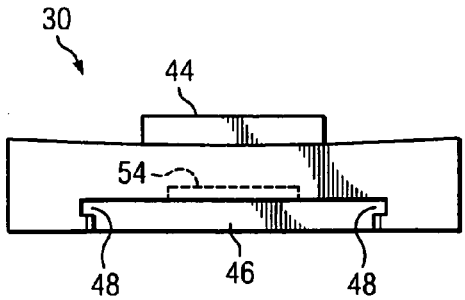
FIG. 3 illustrates a cross-sectional view of the top of the detachedly connected holder.

FIG. 3 illustrates a top view of the detachedly connected holder 30 which shows the open slots 48 on the sides of the depression 46 to accept the personnel holder 78.

Figure 4:
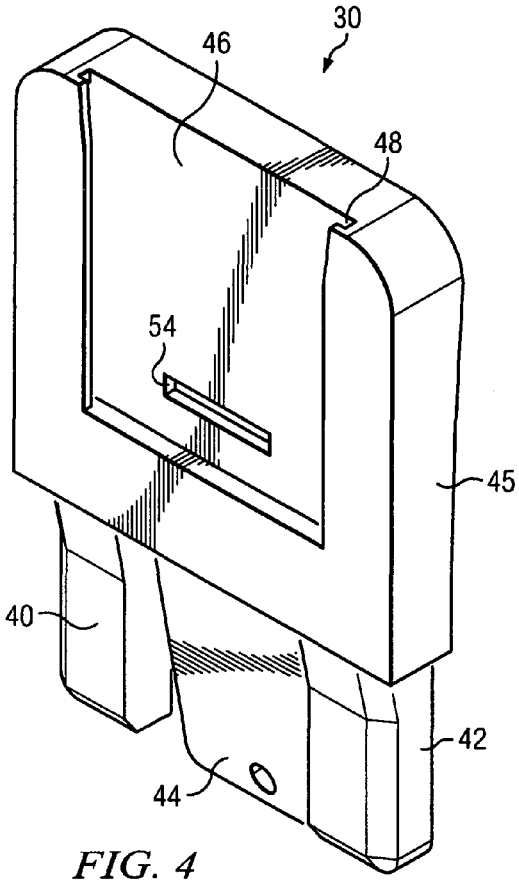
FIG. 4 illustrates a perspective view of the front of the detachedly connected holder.

FIG. 4 illustrates a perspective view of the front side of the detachedly connected holder 30. The engaging arm 44 is shown angled with respect to the guiding arms 40, 42. Additionally, the interior of the detention slot 54 is illustrated within the depression 46.

Figure 5:
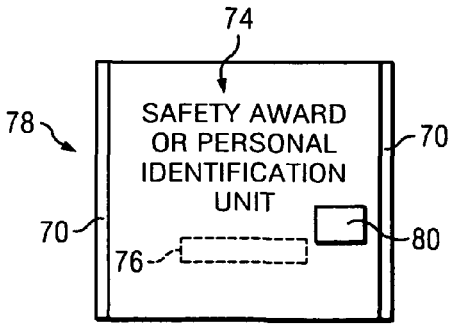
FIG. 5 illustrates a cross-sectional view of the front of the recognition award and/or personnel identification unit.

FIG. 5 illustrates a cross-sectional view of the front side of the personnel unit 78 which may be positioned within depression 46 of the detachedly connected holder 30. The vertical edges 70 of the personnel unit 78 have been reduced in dimension in order to more easily slide into the open slots 48 of the elongated body member 44. FIG. 5 additionally illustrates in phantom line the outwardly projecting tab 76 to engage the detention slot 54. The personnel unit 78 could include an identification chip 80 so that the location of the personnel unit 78 could be determined. Additionally, the personnel unit 78 could be marked with indicia 74 to indicate a safety award or other type of recognition that would be personal to the user of the personnel unit 78.

Figure 6:
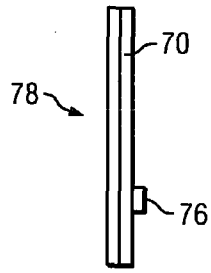
FIG. 6 illustrates a cross-sectional view of the side of the personnel unit.

FIG. 6 shows a cross-sectional view of the side of the personnel unit 78, shows the vertical edges 70 and shows the outwardly projecting tab 76. FIG. 6 shows the vertical edges 70 approximately in the center of the side of the personnel holder 78 extending from the top of the personnel holder 78 to the bottom of the personnel holder 78.

Figure 7:
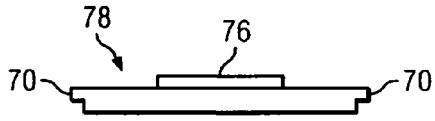
FIG. 7 illustrates a cross-sectional view of another embodiment of the personnel unit.

FIG. 7 shows a cross-sectional view of another embodiment of the top of the personnel unit 78. The vertical edges 70 are positioned towards the back side of the personnel unit 78 in order to project the personnel unit 78 towards the front side of the elongated body member 44. FIG. 7 additionally shows that the outwardly projecting tab 76 is positioned on the back side of the personnel unit 78.

Figure 8:
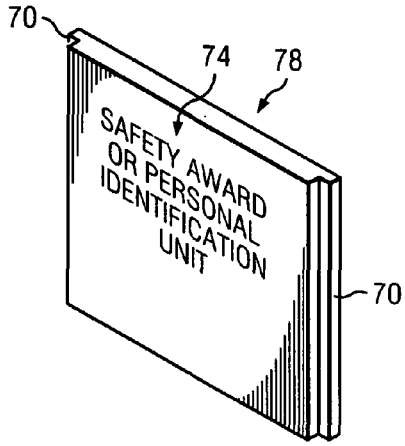
FIG. 8 illustrates a perspective view of another embodiment of the personnel unit.

FIG. 8 illustrates a perspective view of the embodiment shown in FIG. 7 and illustrates indicia 74 on the front side of the personnel unit 78.

Figure 9:
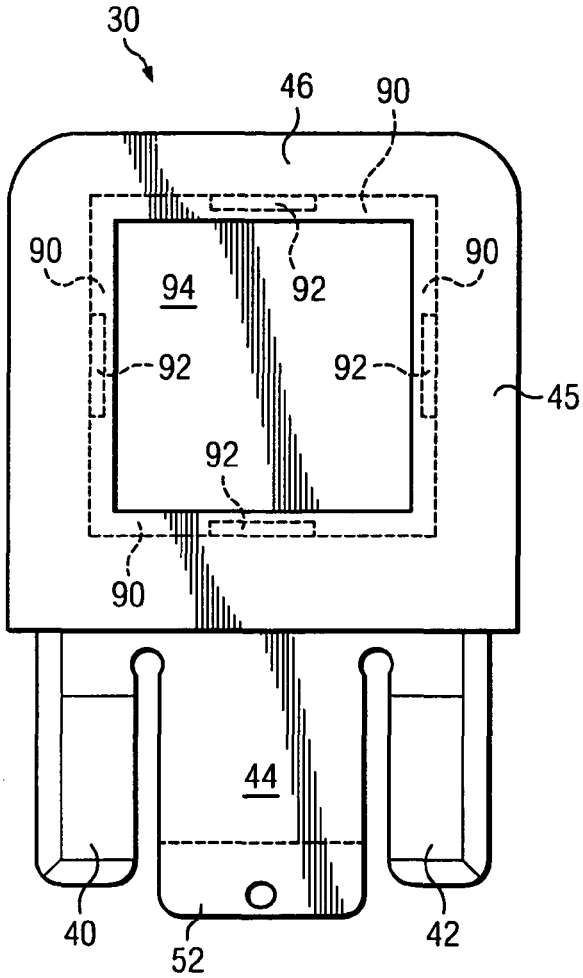
FIG. 9 illustrates a cross-sectional view of another embodiment of the detachedly connected holder.

FIG. 9 illustrates a cross-sectional view of another embodiment of the present invention. In this embodiment, the personnel unit 78 is positioned in approximately the center of the elongated body member 45 in order to the present the personnel unit 78 in a frame like environment. In this embodiment, the elongated body member 45 includes an aperture 94 which extends from the back of the elongated body member 45 to the front of the elongated body member 45. The elongated body member 45 includes a retention channel 90 which extends around the periphery of the aperture 94 and an inwardly projecting element 92 which extend from the retention channel 90 to hold the personnel holder 78 within the aperture 94. The aperture 94 may be covered by clear cover positioned on the front side of the elongated body member 44 in order to protect the personnel holder 78.

Figure 10:
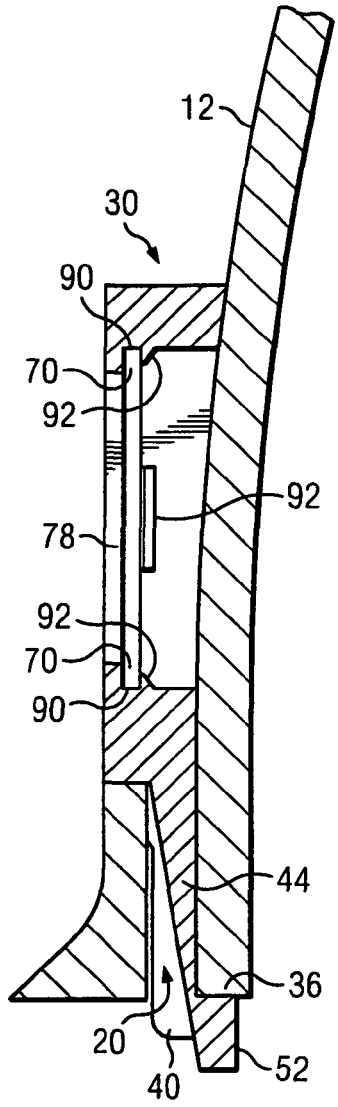
FIG. 10 illustrates a cross-sectional view of the dome shape crown, the detachedly connected holder and the personnel unit.

FIG. 10 illustrates a cross-sectional view of another embodiment of the dome shape crown 12 with the detachedly connected holder 30 and a personnel unit 78. The vertical edges 70 are positioned within the retention channel 90, and the inwardly projecting elements 92 are retaining the vertical edges 70.

The engaging arm 44 is illustrated at an angle with respect to the guiding arms 40, 42 to provide spring pressure when inserted into the pocket 20, and the retention catch 52 latches the bottom edge 36 of the pocket 20. The back side of the detachedly connected holder 30 is concavely curved to approximately conform to the dome shape crown 12 which is convexly curved.

Figure 11:
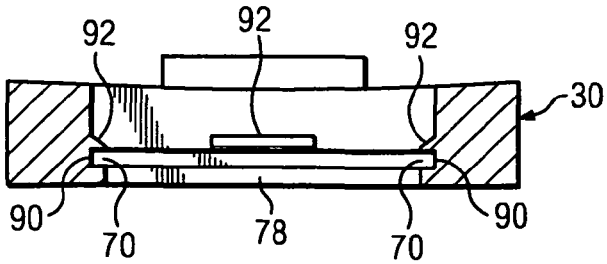
FIG. 11 illustrates a cross-sectional view of the top of the detachedly connected holder.

FIG. 11 illustrates a top view of the detachedly connected holder 30 in accordance with the teachings of the present invention. The personnel unit 78 is positioned by the vertical edges 70 positioned in the retention channel 90 and held by the inwardly projecting elements 92.

Figure 12:
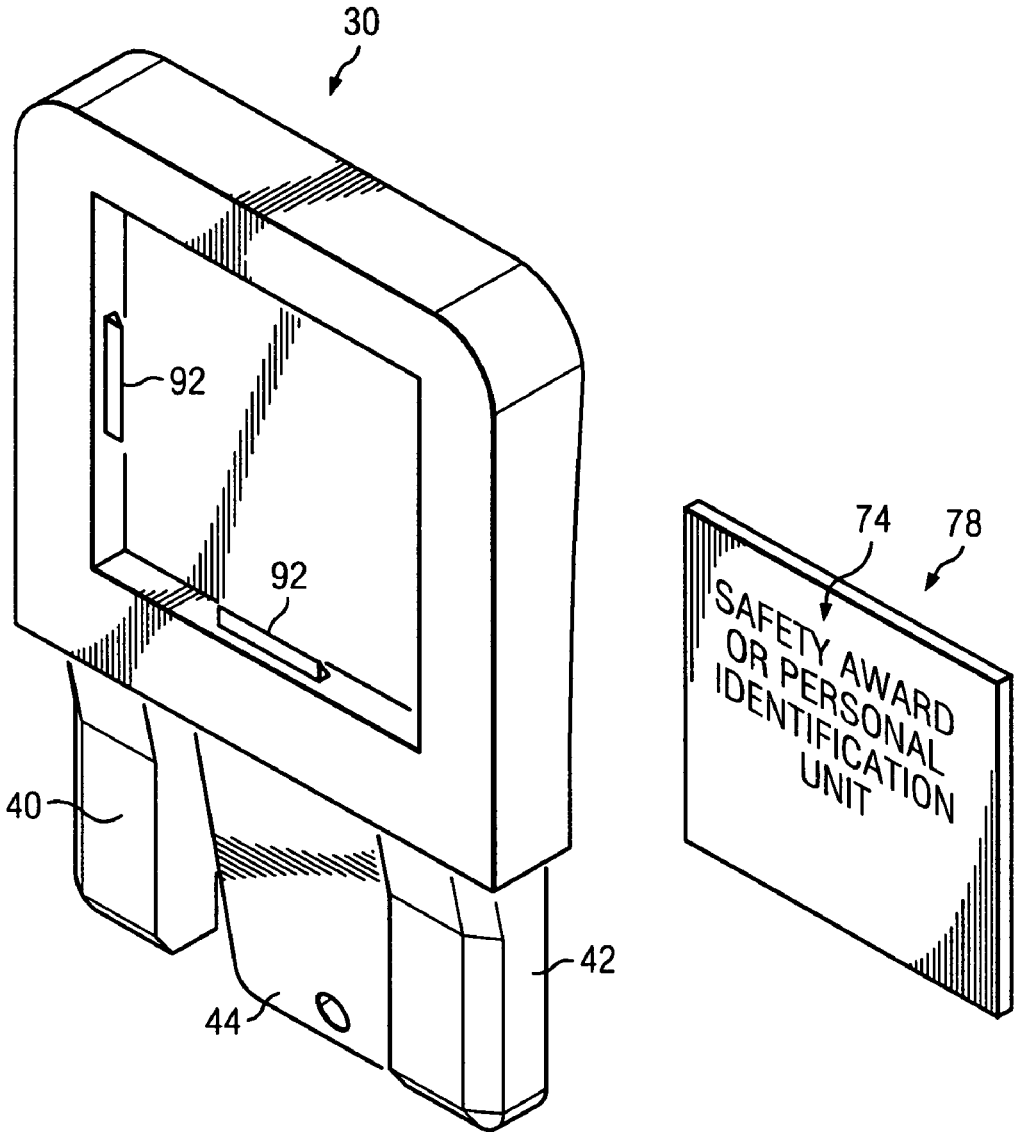
FIG. 12 illustrates an exploded perspective view of the detachedly connected holder and recognition award and/or personnel identification unit.

FIG. 12 illustrates a exploded perspective view and an alternate embodiment of the detachedly connected holder 30 and the personnel unit 78 with indicia 74. The detachedly connected holder 30 includes the guiding arms 40, 42 and the engaging arm 44 to detachedly connect the detachedly connected holder 30 in the pocket 20 of the hard hat 10. The elongated body member 45 includes inward projecting elements 92 to hold the personnel unit 78.

Figure 13:
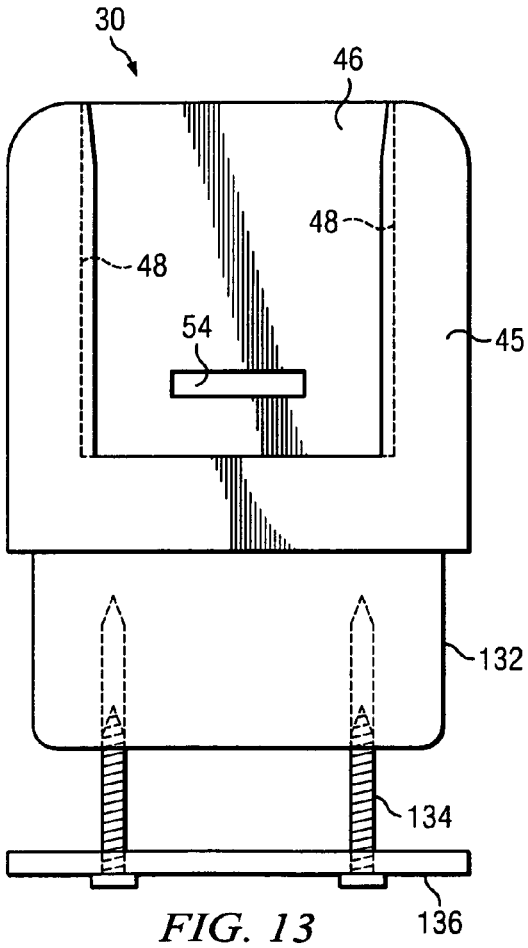
FIG. 13 illustrates a cross-sectional view of an alternate embodiment of the detachedly connected holder of the present invention.

FIG. 13 illustrates a cross-sectional view of an alternate embodiment of the present invention. Similarly to FIG. 1, the elongated body member 45 includes a depression 46 a detention slot 54, the open slot 48. Additionally, the elongated body member 45 illustrated in FIG. 9 could equally be incorporated into the embodiment illustrated in FIG. 13. The elongated body member 45 is mounted on a elongated body base 132 which may be formed from plastic, wood, metal and which may be a substantially solid housing for connection to the pocket 20 by virtue of attachment base 136. The elongated body base 132 is connected to the attachment base 136 by one or more fastening devices which may be screws, bolts, nuts, adhesive, Velcro or any other suitable device. The attachment base 136 may be positioned under the pocket 20 and positioned against the lower edge 36 of the pocket 20 while the elongated body member 45 is positioned against the upper edge 38 of the pocket 20.

Figure 14:
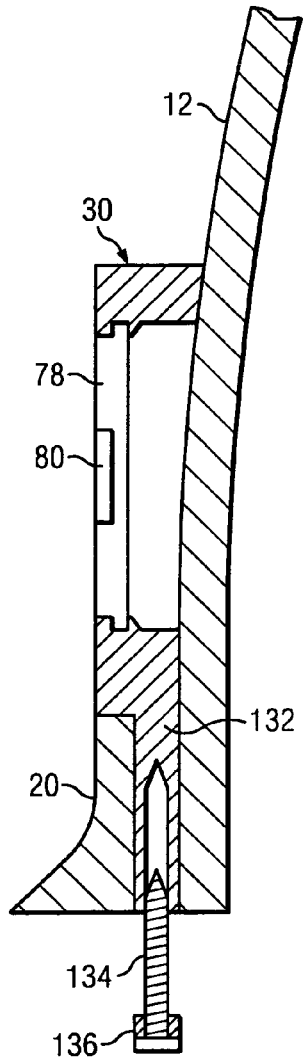
FIG. 14 illustrates a cross-sectional view of an alternate embodiment of the detachedly connected holder and the dome shape crown.

FIG. 14 illustrates a cross-sectional view of the detachedly connected holder 30 that has been connected to the dome shaped crown 12 by virtue of the pocket 20. The elongated body base 132 is connected to the attachment base 136 by virtue of fastening device 134. The embodiment illustrated in FIG. 14 should with more securely attach the detachedly connected holder 30 but may necessitate the use of tools in order to connect the fastening device 134.

The personnel unit 78 and the detachedly connected holder 30 may be constructed a non-conductive plastics and these are molded using injection methods. The detachedly connected holder 30 is inserted into a pocket 20 provided on hardhats 10 as described hereinabove which allows for quick attachment and removal of the detachedly connected holder 30. The personnel unit 78 slides into a depression 46 in the elongated body member 45 or may be attached into the aperture 94 of the elongated body member 45. The personnel unit 78 may include indicia 74 in the form of a recognition award or may include chip 80 to broadcast a signal so that the location of the user can be identified.

Figure 16:
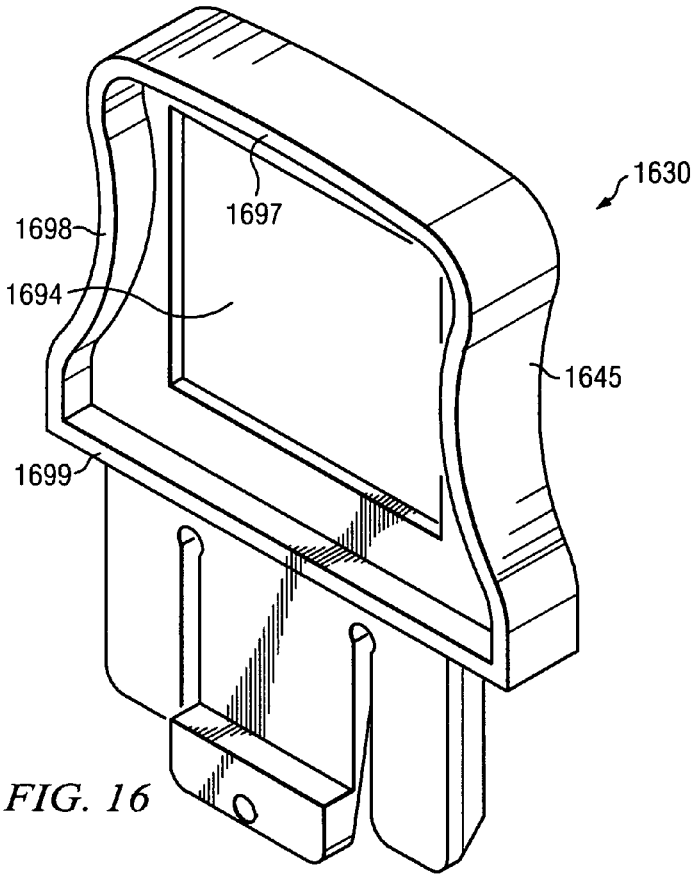
FIG. 16 illustrates a perspective rear view of another embodiment of the detachedly connected holder.

FIG. 16 illustrates a rear perspective view of an alternate embodiment of the detachedly connected holder 1630 which includes a curved elongated body member 1645. The curved elongated body member includes an aperture 1694 positioned approximately in the center of the front side 1696 of the curved elongated body member 1645 to provide an adhesive ledge for retaining the award/identification unit in the rear-view. A side edge 1698, a top edge 1697 and a bottom edge 1699 define the front side 1696 which defines the periphery of the aperture 1694.

Figure 17:
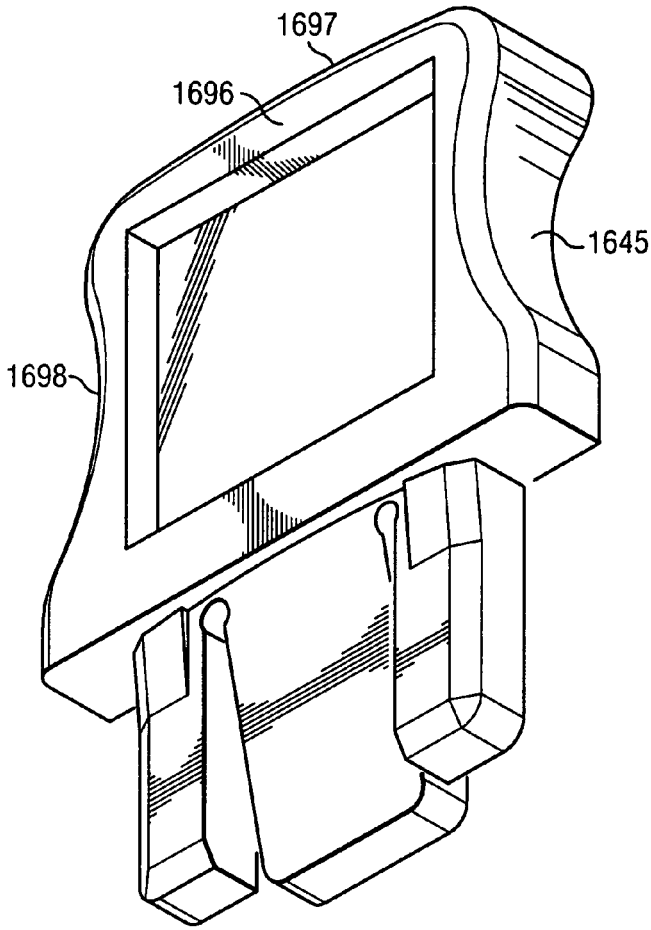
FIG. 17 illustrates a perspective view of the front side of an alternate embodiment of the detachedly connected holder.

FIG. 17 shows a perspective front view of the curved elongated body member of 1645 including the front side 1696, the top edge 1697 and the side edge 1698.

Figure 18:
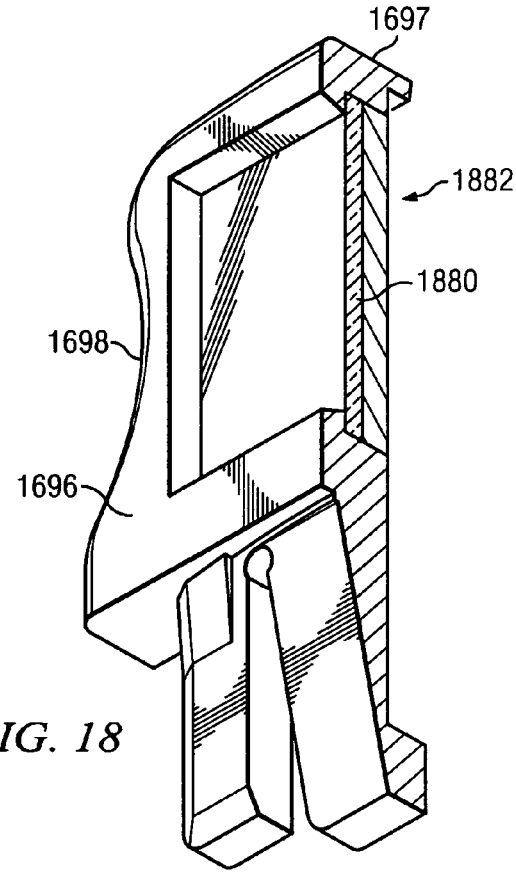
FIG. 18 illustrates a perspective cutaway view of the front side of an alternate embodiment of the detachedly connected holder.

FIG. 18 shows a cutaway view of the detachedly connected holder 1630 with a protective lens 1880 which may be formed of clear plastic and attached to the detachedly connected holder 1630 with adhesive. The protective lens 1880 is positioned against the front side 1696. The personnel unit 1882 is positioned behind the protective lens 1880 and secured in place with adhesive.

Figure 19:
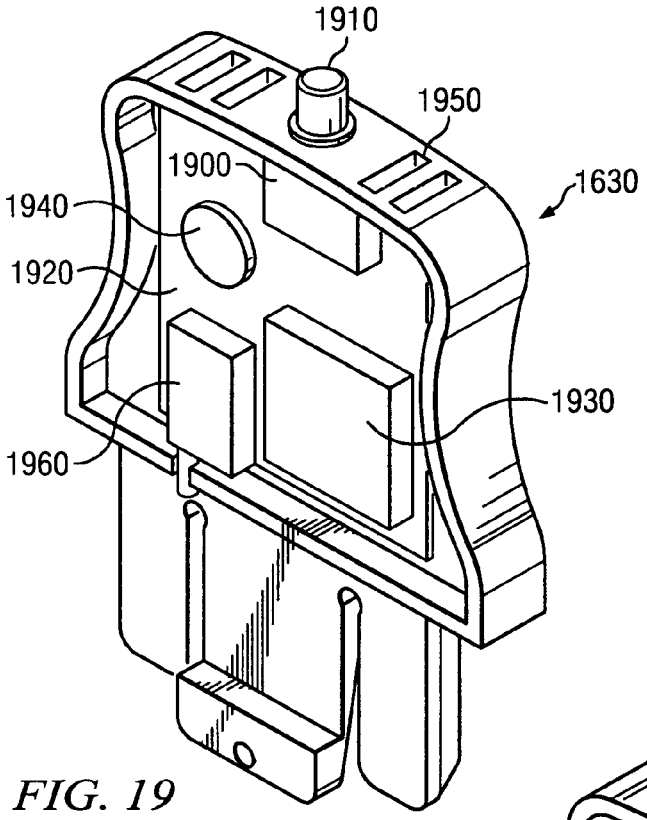
FIG. 19 illustrates a perspective view of the back side of an alternate embodiment of the detachedly connected holder having an LED and speaker assembly located within.

FIG. 19 shows a clip assembly including an LED and speaker. In the preferred embodiment, the clip 1630 is essentially hollow on the back surface. This allows sufficient room to place the components required to produce the light and sound. Speaker vents 1950 allow sound to escape the body of clip 1630. The components are fixed in place with a backfill of epoxy resin.

LED 1900 is in electrical contact with PC board 1920. LED 1900 may be mounted on any of the sides or the front surface of the clip body. Additionally, LED 1900 may incorporate circuitry causing it to flash on and off. LED cover 1910 is positioned over LED 1900, so that light from LED 1900 exits through LED cover 1910. LED cover 1910 may be a lens to focus the light of LED 1900 or a diffuser to spread the light. Switch 1960 is electrically connected between battery 1940 and the other components. Thus, LED 1900 and speaker 1930 are activated when switch 1960 is in the "on" position. Switch 1960 may exist on any side, the front or the rear of clip 1630.

In one embodiment, switch 1960 is position to extend through the lower portion of clip 1630 and contacts upper edge 38 (of FIG. 15). Switch is positioned to be engaged when clip 1630 is locked into position in hardhat 10. This results in speaker 1930 and LED 1900 being active until clip 1630 is removed from hard hat 10.

Mechanical switches or Hall effect switches are alternate embodiments which function well. Other switches as known in the art may also be employed. Hall effect switches have the advantage of allowing the housing to be sealed when in use. In this embodiment, a small metal artifact is embedded in the hard hat adjacent the switch in the housing and is positioned to activate the switch when the catch engages the rim of the hard hat.

Figure 21:
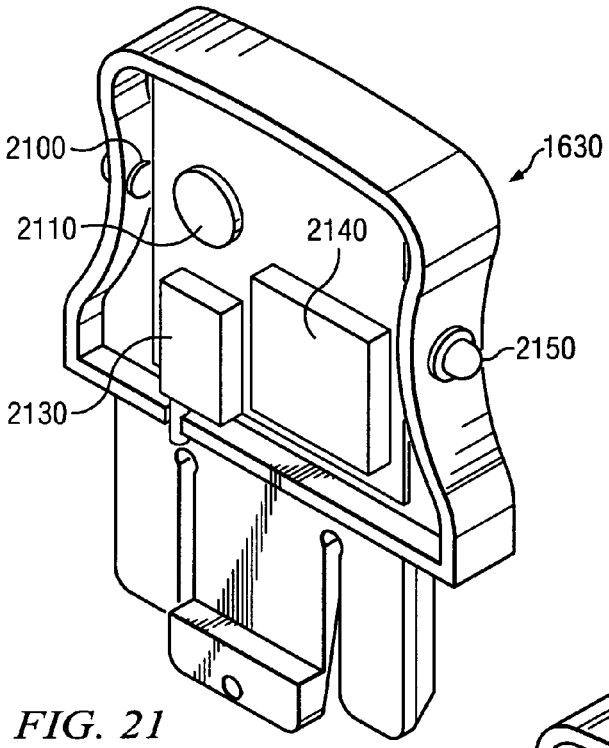
FIG. 21 illustrates a perspective view of the back side of an alternate embodiment of the detachably connected holder including forward and rearward looking LEDs and controlling circuits.

FIG. 21 shows an alternate position for placement of LEDs. In this embodiment forward looking LED 2150 is a white, high-intensity LED and is positioned to face forward and project a beam of light in front of the wearer. Rearward looking LED 2100 is a red, high-intensity LED and is positioned in the opposite side of clip 1630 and faces the back of the hardhat when in use. LED 2100 and LED 2150 draw power from battery 2110 and are activated by switch 2130 and are connected to control circuit 2140. Control 2140 includes circuitry to blink rear looking LED 2100 as a safety feature. In a preferred embodiment, the control circuit includes a simple RC network operating as a timer. However, other timing circuits as know in the art may be employed with equal success. A preferred embodiment LED 2150 may be part number BLMW711AEGS08 available from Vishay. Rear looking LED may be part number BLMR71AAAC-GS08, also available from Vishay.

Figure 23:
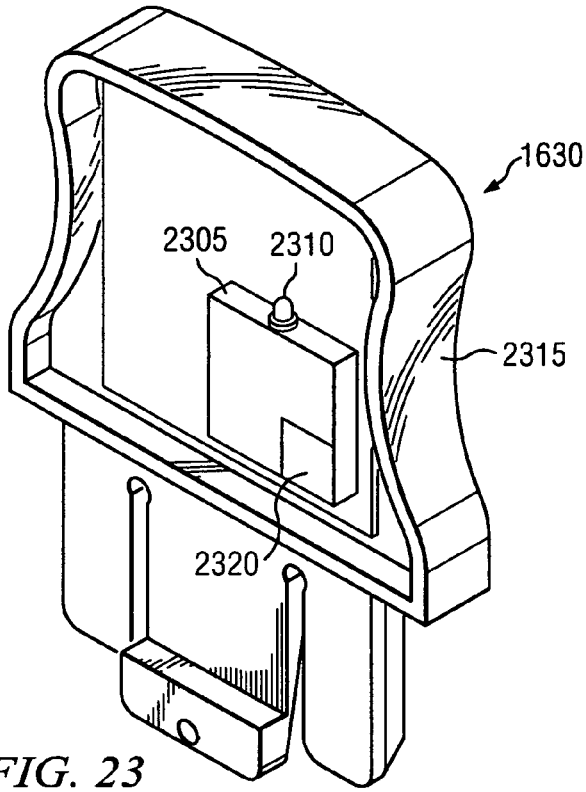
FIG. 23 illustrates a perspective view of the back side of an alternate embodiment of the detachably connected holder including an internal facing light source.

FIG. 23 shows an alternate embodiment of clip 1630. In this embodiment, LED 2310 is placed inside translucent housing 2315. LED 2310 is mounted adjacent to controller 2305 which also includes a sealed battery (not shown). In this embodiment, the housing is backfilled with a translucent epoxy filling. Hall effect sensor 2320 is included adjacent controller 2305.

In use, when clip 1630 is in position on the hard hat, Hall effect sensor 2320 is positioned adjacent a sensor or metallic artifact in the hard hat. The Hall effect sensor activates 2305 which in turn illuminates LED 2310. LED 2310 in turn illuminates the entirety of translucent housing 2315 and the translucent epoxy backfill for increased visibility of clip 1630 and the wearer.

In alternate embodiments, LED 1900, LEDs 2100 and 2150, and LED 2310 may all emit infrared or ultraviolet radiation for detection of warning or security breach signals emitted by the clip. In these embodiments, infrared or ultraviolet cameras can be used to detect a signal from the clip without alerting the wearer that a signal has been communicated.

Returning to FIG. 19, speaker 1930 is connected to control circuit 2140 (of FIG. 21). In a preferred embodiment, the control circuit includes a motion dwell circuit that functions as a "dead man" alarm. The control circuit comprises a motion-activated switch, such as a sealed mercury switch, connected to a timing circuit. If no motion is detected for a certain period of time, the circuit activates an alarm waveform generator. The signal generated is sent to the speaker to produce an audible alarm. The alarm indicates a lack of motion and presumably a "man down" condition.

In an alternate embodiment, the alarm waveform generator is connected to an accelerometer circuit. In this embodiment, the accelerometer activates the waveform generator when an impact is detected. A sudden impact presumably indicates a fall of the wearer and again indicates a "man down" condition.

Alternatively, the LED and audible alarm circuit are activated by manual activation of the switch and remain active until switched off. The light and sound would allow rescuers to locate an injured worker, for example.

An alternate embodiment, LED cover 1910 is a lens that focuses light from LED 1900 in a chosen direction. LED cover 1910 is directional so that the focus of the LED can be rotated to a desired position.

In an alternate embodiment, clip 1630 includes protective lens 1880, as shown in FIG. 18. A message is placed behind protective lens 1880. An LED is positioned to illuminate the message. Thus, the design is backlit causing the message to be accentuated.

In another alternate embodiment, protective lens 1880, includes a highly reflective material or is placed behind protective lens 1880. In addition to being reflective, the material may also be luminescent or phosphorescent. Thus, clip 1630 provides protection for wearers in direct light and no light situations. The material may be formed into a design, phrase or number.

Figure 20:
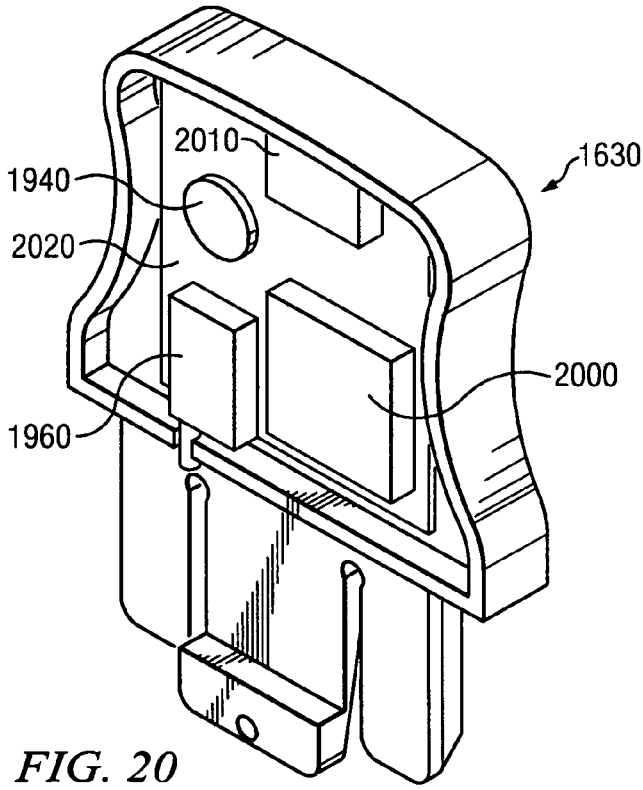
FIG. 20 illustrates a perspective view of the back side of an alternate embodiment of the detachedly connected holder having a GPS transponder located within.

FIG. 20 shows a GPS (global positioning system) transponder or tracking assembly located in the hollow back portion of clip 1630. GPS and AGPS (assisted global positioning system) are well known.

A tracking assembly is composed of transponder 2000, a battery 1940 and an antenna 2010. Transponder 2000 generates a signal on a specified frequency that can be tracked by the satellite system. Transponder 2000 is electrically connected to battery 1940, switch 1960 and antenna 2010 through circuit board 2020. Antenna 2010 increases the range of transponder 2000 by increasing the power of the signal.

Circuit board 2020 connects the major components as well as providing any additional functions or circuits required to increase functionality, for example buffering or amplification of the signal. Among the additional circuits are circuits to activate an alarm if the GPS transponder indicates any "out of bound" condition. The circuit board may also incorporate a switch which communicates an "on" condition when the clip is attached to the hard hat by the engagement of the catch with the bottom rim of the hard hat. An example is shown in FIG. 19 as switch 1960.

Figure 22:
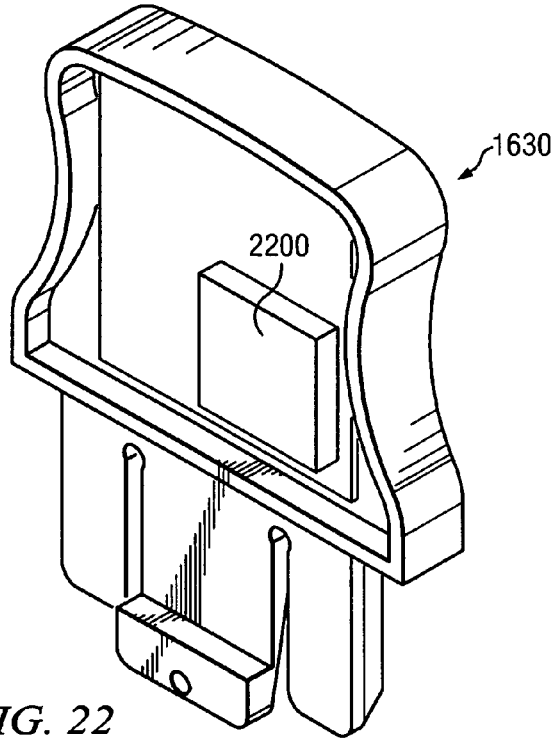
FIG. 22 illustrates a perspective view of the back side of an alternate embodiment of the detachably connected holder including a personal dosimeter.

In FIG. 22, an alternate embodiment is shown which includes multi-purpose module 2200 mounted on the inside of clip 1630. Multi-purpose module 2200 in the preferred embodiment includes a personal dosimeter such as the NVLAB accredited Panasonic UD-802A thermoluminescent dosimeter which is designed for monitoring radiation exposure from x-ray, gamma, beta radiation, as well as other forms of known energy. The badge measures radiation doses at several tissue depths which correspond to the deep, shallow and "eye" doses required by federal regulations and industrial radiation environments.

In an alternate embodiment, still shown in FIG. 22, multi-purpose module 2200 can include an RFID (radio frequency identification) tag for the purpose of identification and tracking using radio waves. Multi-purpose module 2200 in this case includes an integrated circuit for storing and processing information, modulating and de-modulating a radio frequency. Multi-purpose module 2200 also includes an antenna for receiving and transmitting a radio signal. In this preferred embodiment, an appropriate RFID tag is manufactured by Alien Technology of Morgan Hill, Calif.

An RFID tag may include a "kill command" that erases the information stored in the tag. A signal and a power supply are required to initiate the kill command. An alternate embodiment combines the switch 2130 and the battery 2110 from figure 21 with the multipurpose module 2200 of FIG. 22. Switch 2130, battery 2110, and multipurpose module 2200 are connected via circuit board 2020. After clip 1630 is inserted into pocket 20 (not shown), switch 2130 is depressed. When clip 1630 is removed, switch 2130 is released executing the kill command and erasing the information stored in multipurpose module 2200. As the RFID tag cannot be removed without damage, escaping tracking becomes more difficult.

Another method of disabling RFID tags is known as "clipping." Clipping is the destruction of the antenna of a RFID tag, thus limiting its range to approximately an inch. As a result of clipping the RFID tag no longer functions as an identification and tracking system. One benefit of clipping is that it does not require a power supply.

Figure 24:
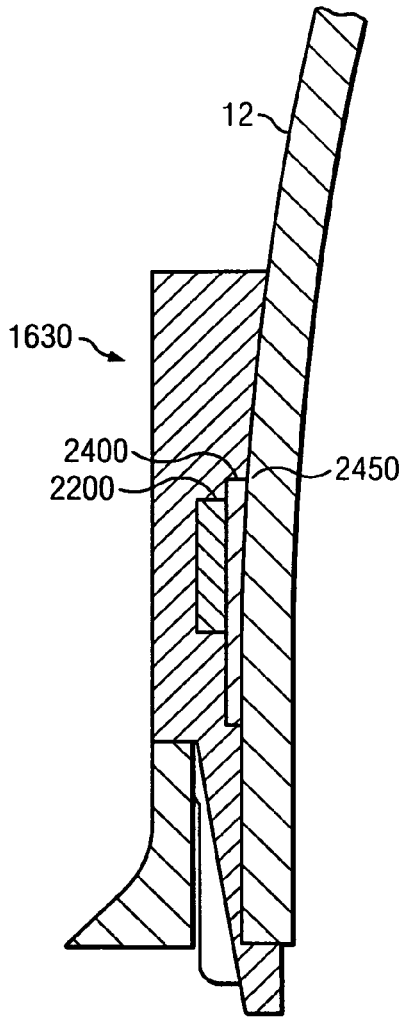
FIG. 24 illustrates a cross-sectional view of an alternate embodiment of the detachably connected holder using clipping.

FIG. 24 shows a cross section of an alternate embodiment of the invention that uses clipping. Antenna 2400 is communicatively connected with multipurpose module 2200. Antenna 2400 incorporates adhesive backing 2450. After clip 1630 is inserted into pocket 20 (not shown), adhesive backing 2450 attaches to dome-shaped crown 12. Adhesive backing 2450 attaches firmly enough that antenna 2400 is separated from multipurpose module 2200 when clip 1630 is removed. Thus, the RFID tag is clipped and effectively blocked from long range RFID scanners.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. A signal device for detachably mounting on a hard hat, the hard hat having a rigid open support loop and a bottom rim, the signal device comprising:

at least two parallel support stanchions rigidly attached to a housing, where the housing includes an upper portion, a back surface, and a lower portion;

at least one resilient locking stanchion attached to the housing;

the at least one resilient locking stanchion further comprising a catch detachably engaging the bottom rim;

the at least two parallel support stanchions and the locking stanchion removably positioned within the support loop; and the housing supporting a light source connected to an internal power source and an activation switch mounted on the housing, where the activation switch contacts the support loop for enabling functioning of the light source when the locking stanchion is engaged with the bottom rim.

2. The signal device of claim 1 wherein the light source includes a forward looking light emitting diode extending from the housing and a rearward looking light emitting diode extending from the housing; and wherein the rearward looking light emitting diode is controlled by a timing circuit to enable blinking.

3. The signal device of claim 1 wherein the light source is supported by the housing with a moveable coupling to enable positioning of a beam of light from the light source.

4. The signal device of claim 1 further comprising a speaker supported by the housing and connected to a waveform generator for creating an alarm signal through the speaker.

5. The signal device of claim 1 wherein the housing is constructed of translucent material; and the light source is directed internally with respect to the housing.

6. The signal device of claim 1 further comprising an accelerometer within the housing, attached to a controller and the light source, whereupon detection of a predetermined deceleration activates the light source.

7. The signal device of claim 1 further comprising:

an RFID tag mounted on the housing;

an antenna communicatively connected to the RFID tag and attached to the hard hat; and whereby the antenna is disconnected from the RFID tag when the signal device is removed from the hard hat.

8. The signal device of claim 1 further comprising:

an electronic tag mounted on the housing;

the electronic tag attached to the housing and connected to the activation switch;

whereby a set of information stored on the electronic tag is erased when the signal device is removed from the hard hat.

9. A signal device for mounting on a hard hat, the hard hat having a rigid, open support loop and a bottom rim, the signal device comprising:

a housing having a lower portion and a back surface;

at least two parallel support stanchions rigidly attached to the;

at least one resilient locking stanchion attached to the housing;

the at least one resilient locking stanchion further comprising a catch detachably engaging the bottom rim;

the at least two parallel support stanchions and the locking stanchion removably positioned within the support loop;

an activation switch, attached to the housing and contacting the support loop, for communicating an activation signal when the catch is engaged with the bottom rim; and a transponder, residing within the housing, for communicating a location signal when the catch is engaged with the bottom rim.

10. The signal device of claim 9 wherein the transponder is an RFID tag.

11. The signal device of claim 10 wherein the RFID tag is erased if the signal device is removed from the hard hat.

12. The signal device of claim 10 wherein the RFID tag further comprises an antenna and wherein the antenna is disengaged from the RFID tag if the signal device is removed from the hard hat.

13. The signal device of claim 9 further comprising an infrared LED light source supported by the housing; and, a controller for activating the infrared light source upon communication of the location signal.

14. The signal device of claim 9 wherein the transponder further comprises:

a GPS transponder, connected to a battery and an antenna;

the battery and antenna concealed and supported by the housing.

15. The signal device of claim 14 further comprising a controller, connected to the GPS transponder and to an alarm unit, for activating the alarm unit when the GPS transponder indicates an out of bounds signal.

* * * * *